US010704454B2

(12) United States Patent
Lee

(10) Patent No.: US 10,704,454 B2
(45) Date of Patent: Jul. 7, 2020

(54) CONTROL METHOD OF COOLING SYSTEM

(71) Applicants: Hyundai Motor Company, Seoul (KR); Kia Motors Corporation, Seoul (KR)

(72) Inventor: Yonggyu Lee, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/181,939

(22) Filed: Nov. 6, 2018

(65) Prior Publication Data

US 2020/0040801 A1 Feb. 6, 2020

(30) Foreign Application Priority Data

Aug. 6, 2018 (KR) ..... 10-2018-0091341

(51) Int. Cl.
*F01P 7/14* (2006.01)
*F01P 3/12* (2006.01)
*F01P 3/02* (2006.01)

(52) U.S. Cl.
CPC ..... *F01P 7/14* (2013.01); *F01P 3/02* (2013.01); *F01P 3/12* (2013.01); *F01P 2003/024* (2013.01); *F01P 2007/146* (2013.01); *F01P 2025/13* (2013.01); *F01P 2025/50* (2013.01); *F01P 2060/18* (2013.01)

(58) Field of Classification Search
CPC ..... F01P 7/14; F01P 3/02; F01P 3/12
See application file for complete search history.

(56) References Cited

U.S. PATENT DOCUMENTS

2002/0005178 A1* 1/2002 Iwatani ..... F01M 5/021 123/41.14
2006/0005790 A1* 1/2006 Braun ..... F01P 7/167 123/41.08
2006/0157000 A1* 7/2006 Lutze ..... F01P 3/20 123/41.02
2019/0120178 A1* 4/2019 Park ..... F01P 7/165

* cited by examiner

*Primary Examiner* — Kevin A Lathers
(74) *Attorney, Agent, or Firm* — Mintz Levin Cohn Ferris Glovsky and Popeo, P.C.; Peter F. Corless

(57) ABSTRACT

A control method for a cooling system is provided. The system includes a vehicle operation state detecting portion having an ambient temperature sensor, first and second coolant temperature sensors, a coolant control valve unit that adjusts opening rates of first, second, and third coolant passages and a controller. The method includes determining whether an output signal of the ambient temperature sensor satisfies a predetermined an ambient low temperature driving condition and whether an output signal of the first coolant temperature sensor satisfies a predetermined first low temperature driving condition when the output signal of the ambient temperature sensor satisfies the predetermined the ambient low temperature driving condition. The coolant control valve unit opens the first and coolant passages and closes the second coolant passage when the output signal of the first coolant temperature sensor satisfies the predetermined first low temperature driving condition.

7 Claims, 5 Drawing Sheets

CONTROL METHOD OF COOLING SYSTEM

CROSS-REFERENCE TO RELATED APPLICATION

This application claims priority to and the benefit of Korean Patent Application No. 10-2018-0091341 filed on Aug. 6, 2018, the entire contents of which are incorporated herein by reference.

BACKGROUND

(a) Field of the Invention

The present invention relates to a control method of a cooling system, and more particularly, to a control method of a cooling system that improves heating performance of a vehicle.

(b) Description of the Related Art

One of the integrated heat management technologies researched the separation cooling technology which improves fuel efficiency by independently adjusting coolant temperature of cylinder head and engine block. In engines with separate cooling technology, the flow is stopped during warm-up to increase the blocks temperature. When coolant flow stops in an engine block, since the coolant is not discharged from the engine block, the heating performance may be deteriorated since the coolant flow rate to a heater is relatively low. In particular, diesel engines have a much slower warm-up speed than gasoline engines, making it difficult to achieve heating performance in low outside temperature regions.

The above information disclosed in this section is merely for enhancement of understanding of the background of the invention and therefore it may contain information that does not form the prior art that is already known in this country to a person of ordinary skill in the art.

SUMMARY

The present invention provides a control method of a cooling system for improving heating performance. In particular, it is an object of the present invention to provide a control method of a cooling system that improves the heating performance of a cooling system to which an engine for independently adjusting the coolant temperature of the cylinder head and the engine block is applied.

A control method according to an exemplary embodiment of the present invention may be applied to a cooling system including a vehicle operation state detecting portion having an ambient temperature sensor configured to detect a temperature of ambient air and output a corresponding signal, a first coolant temperature sensor configured to detect a temperature of coolant flowing through a cylinder head and output a corresponding signal and a second coolant temperature sensor configured to detect a temperature of coolant flowing through an engine block and output a corresponding signal, a coolant control valve unit configured to receive coolant from the cylinder head and adjust opening rates of a first coolant passage in communication with a heater, a second coolant passage in communication with a radiator and a third coolant passage in communication with the engine block and a controller configured to operate the coolant control valve unit according to the output signals of the vehicle operation state detecting portion.

The control method may include determining, by the controller, whether the output signal of the ambient temperature sensor satisfies a predetermined an ambient low temperature driving condition, determining, by the controller, whether the output signal of the first coolant temperature sensor satisfies a predetermined first low temperature driving condition when the output signal of the ambient temperature sensor satisfies the predetermined the ambient low temperature driving condition and operating, by the controller, the coolant control valve unit to open the first coolant passage and the third coolant passage and to close the second coolant passage when the output signal of the first coolant temperature sensor satisfies the predetermined first low temperature driving condition.

Additionally, the control method may include operating, by the controller, the coolant control valve unit to adjust the opening rate of the first coolant passage and to close the second coolant passage and the third coolant passage when the output signal of the first coolant temperature sensor does not satisfy the predetermined first low temperature driving condition. The control method may further include determining, by the controller, whether the heater is operated and operating, by the controller, the coolant control valve unit to adjust the opening rate of the first coolant passage and to close the second coolant passage and the third coolant passage when the heater is operated.

Further, the control method may include determining, by the controller, whether the output signal of the first coolant temperature sensor satisfies a predetermined second low temperature driving condition when the heater is not operated and operating, by the controller, the coolant control valve unit to close the first coolant passage, the second coolant passage and the third coolant passage when the output signal of the first coolant temperature sensor satisfies the predetermined second low temperature driving condition. The coolant control valve unit may be further operated to adjust the opening rate of the first coolant passage and to close the second coolant passage and the third coolant passage when the output signal of the first coolant temperature sensor does not satisfy the predetermined second low temperature driving condition.

The control method may further include determining, by the controller, whether the output signal of the first coolant temperature sensor satisfies a predetermined warn driving condition and operating, by the controller, the coolant control valve unit to be operated in a normal driving mode when the output signal of the first coolant temperature sensor satisfies the predetermined warn driving condition. Additionally, the control method may include determining, by the controller, whether the output signal of the second coolant temperature sensor satisfies a high temperature driving condition and operating, by the controller, the coolant control valve unit to close first coolant passage, the second coolant passage and the third coolant passage when the output signal of the second coolant temperature sensor satisfies the high temperature driving condition.

The control method of the cooling system according to the exemplary embodiment of the present invention may improve the heating performance of the vehicle of the cooling system to which the engine for independently controlling the coolant temperature of the cylinder head and the engine block is applied. Fuel efficiency may be improved by implementing the flow stop and the separation cooling when the outside temperature or the coolant temperature is high.

BRIEF DESCRIPTION OF THE DRAWINGS

A brief description of the drawings will be provided to more sufficiently understand the drawings which are used in the detailed description of the present invention.

DESCRIPTION OF SYMBOLS

Figure 1:
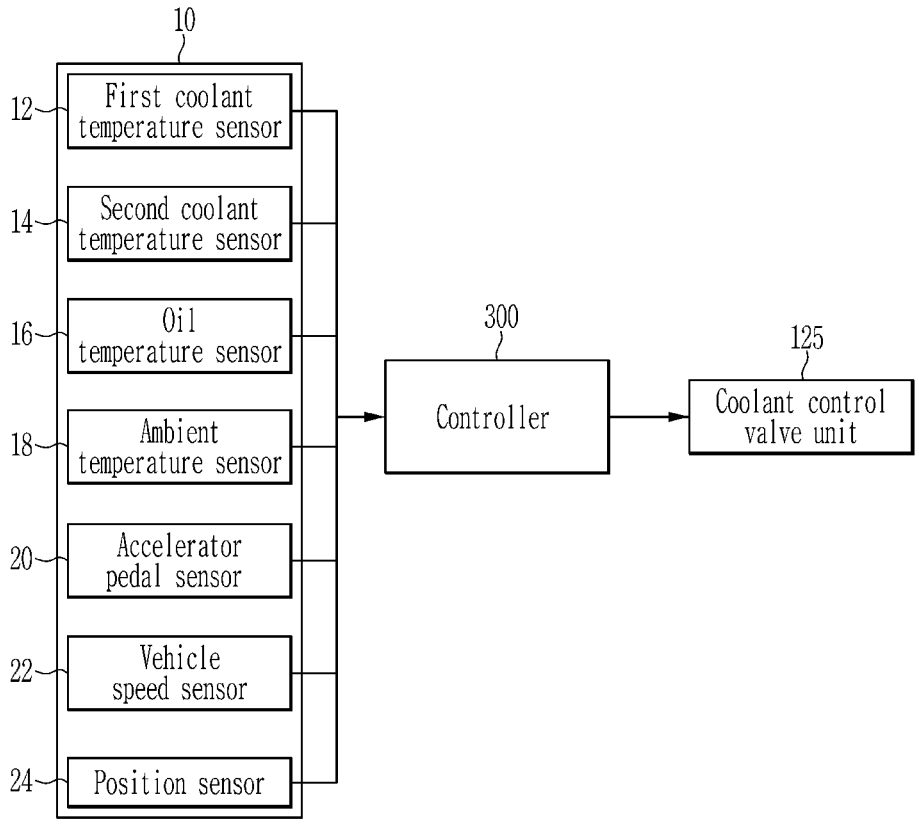
FIG. 1 is a block diagram of a control system applicable to a control method according to an exemplary embodiment of the present invention.

10: vehicle operation state detecting portion
12: first coolant temperature sensor
14: second coolant temperature sensor
16: oil temperature sensor
18: ambient temperature sensor
20: accelerator pedal sensor
22: vehicle speed sensor
24: position sensor
90: engine
100: engine block
105: cylinder head
110: LP-EGR cooler
115: heater
125: coolant control valve unit
130: radiator
135: oil cooler
140: oil control valve 1
45: HP-EGR valve
155: coolant pump
210: cam
215*a*: first rod
215*b*: second rod
215*c*: third rod
220: valve
220*a*: first valve
220*b*: second valve
220*c*: third valve
225*a*: first elastic member
225*b*: second elastic member
225*c*: third elastic member
230*a*: first coolant passage
230*b*: second coolant passage
230*c*: third coolant passage
300: controller
305: motor
310: gear box
320*a*: first track
320*b*: second track
320*c*: third track

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

Furthermore, control logic of the present invention may be embodied as non-transitory computer readable media on a computer readable medium containing executable program instructions executed by a processor, controller/control unit or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Hereinafter, an exemplary embodiment of the present invention will be described in detail with reference to the accompanying drawings. However, the size and thickness of each component illustrated in the drawings are arbitrarily shown for ease of description and the present invention is not limited thereto, and the thicknesses of portions and regions are exaggerated for clarity. In addition, parts that are irrelevant to the description are omitted to clearly describe the exemplary embodiments of the present invention, and like reference numerals designate like elements throughout the specification.

In the following description, dividing names of components into first, second, and the like is to divide the names because the names of the components are the same, and an order thereof is not particularly limited.

Figure 2:
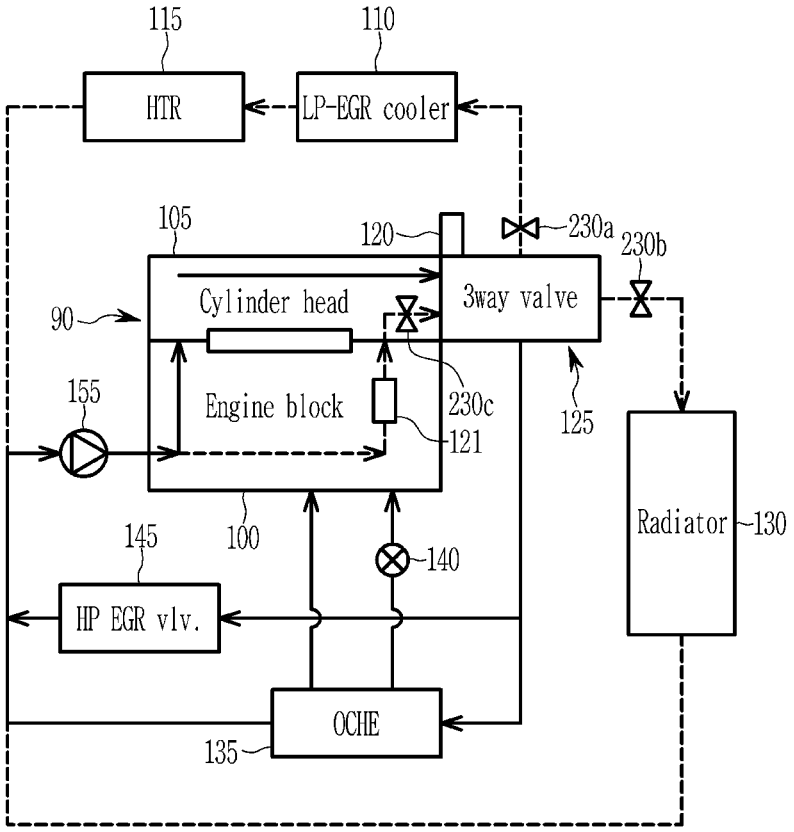
FIG. 2 is a schematic diagram of a control system applicable to a control method according to an exemplary embodiment of the present invention.

FIG. 1 is a block diagram of a control system applicable to a control method according to an exemplary embodiment of the present invention and FIG. 2 is a schematic diagram of a control system applicable to a control method according to an exemplary embodiment of the present invention. Referring to FIG. 1 and FIG. 2, a cooling system according to an exemplary embodiment of the present invention may include a controller 300 configured to operate a coolant control valve unit 125 based on an output signal of the vehicle operation state detecting portion 10.

In particular, the vehicle operation state detecting portion 10 may include a first coolant temperature sensor 12, a second coolant temperature sensor 14, an oil temperature sensor 16 configured to detect engine oil temperature and output a corresponding signal, an ambient temperature sensor 18 configured to detect ambient air temperature and output a corresponding signal, an accelerator pedal sensor 20 configured to detect an operation angle of an accelerator pedal and output a corresponding signal, a vehicle speed sensor 22 configured to detect a speed of a vehicle and output a corresponding signal and a position sensor 24. The controller 300 may be implemented as one or more microprocessors operating by a predetermined program, and the predetermined program may include a series of commands for performing the exemplary embodiment of the present invention.

The cooling system which may be applied to a control system according to an exemplary embodiment of the present invention may include an engine 90 including an engine block 10 and a cylinder heat 105, a low pressure exhaust gas recirculation (LP-EGR) cooler 110, a heater 115, a radiator 130, an oil cooler 135, an oil control valve 140, a high pressure exhaust gas recirculation (HP-EGR) valve 145 and a coolant pump 155. The coolant pump 155 may be configured to pump the coolant to a coolant inlet side of the engine block 100 and the pumped coolant may be distributed to the engine block 100 and the cylinder head 105. The coolant control valve unit 125 may be configured to receive the coolant from the cylinder head 105 and adjust an opening rate of a coolant outlet side coolant passage of the engine block 100. The first coolant temperature sensor 12 may be configured to sense the temperature of the coolant exhausted from the cylinder head 105 disposed on the coolant control valve unit 125. The second coolant temperature sensor 14 may be configured to sense the temperature of the coolant exhausted from the engine block 100 disposed on the engine block 100.

The coolant control valve unit 125 may be configured to respectively control the coolant flow distributed to the heater 115 and the radiator 130. In particular, the coolant may pass through the low pressure EGR cooler 110 before passing through the heater 115, and the heater 115 and the low pressure EGR cooler 110 may be disposed in series or in parallel. The heater 115 may not be limited to an element for heating inside of a vehicle. In other words, the heater 115 in detailed description and claims may be a heater, an air conditioner, or a Heating, Ventilation and Air Conditioning (HVAC) and so on.

The coolant control valve unit 125 may be configured to continuously supply the coolant to the HP-EGR valve 145 and the oil cooler 135. Additionally, a part of engine oil circulated along the engine block 100 and the cylinder head 105 may be cooled while circulating the oil cooler or oil coolant heat exchanger 135, and the oil control valve 140 may be disposed between the engine 90 and the oil cooler or oil coolant heat exchanger 135 to adjust the flow of the oil. The structure and the function of the constituent elements according to an exemplary embodiment of the present invention is well known in the art, and a detailed description thereof will be omitted.

Figure 3:
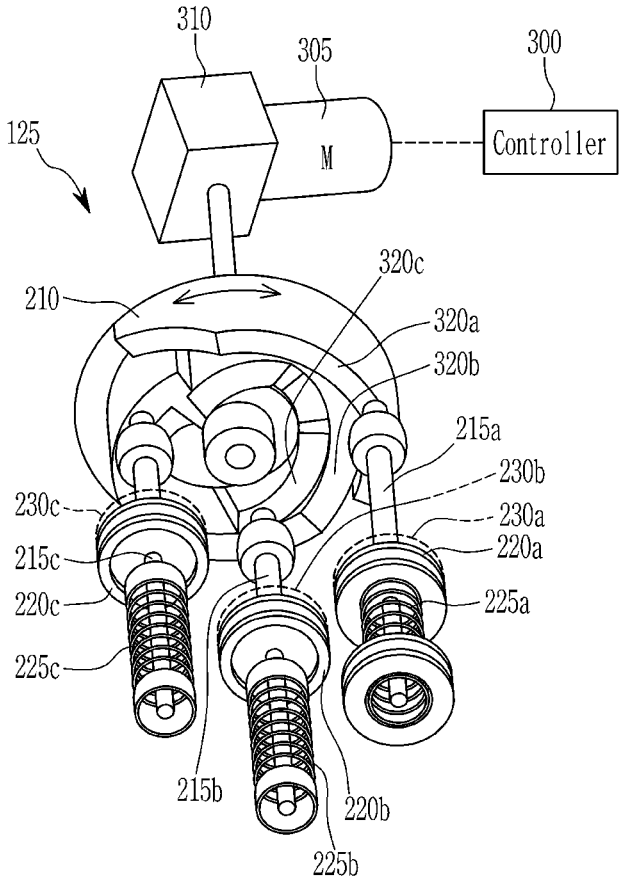
FIG. 3 is a detailed perspective view of a coolant control valve unit of a control system applicable to a control method according to an exemplary embodiment of the present invention.

FIG. 3 is a detailed perspective view of a coolant control valve unit of a control system applicable to a control method according to an exemplary embodiment of the present invention. Referring to FIG. 3, the coolant control valve unit 125 may include a cam 210, tracks formed to the cam 210, rods contacting the tracks, valves connected with the rods and elastic members biasing the valves and the valves may close coolant passages.

A plurality of tracks, for example, a first track 320*a*, a second track 320*b*, and a third track 320*c*, each having a predetermined inclination and height, and a plurality of rods, for example, a first rod 215*a*, a second rod 215*b*, and a third rod 215*c*, may be disposed in a lower portion of the cam 210 such that the first, second, and third rods 215*a*, 215*b*, and 215*c* that respectively contact the first, second, and third tracks 320*a*, 320*b*, and 320*c* may move downward depending on a rotation position of the cam 210. In addition, the elastic member may include three elastic members, i.e., a first elastic member 225*a*, a second elastic member 225*b*, and a third elastic member 225*c* to respectively elastically support the first, second, and third rods 215*a*, 215*b*, and 215*c*.

While the first, second, and third elastic members 225*a*, 225*b*, and 225*c* are compressed based on the rotation position of the cam 210, a first valve 220*a*, a second valve 220*b*, and a third valve 220*c* respectively mounted to the first, second, and third rods 215*a*, 215*b*, and 215*c* open and close a first coolant passage 230*a*, a second coolant passage 230*b*, and a third coolant passage 230*c*. In particular, opening rates of each passage 230*a*, 230*b*, and 230*c* may be adjusted according to the rotation position of the cam 210.

The controller 300 may be configured to receive vehicle operation conditions, (e.g., a coolant temperature, an ambient air temperature, a rotation position signal of the position sensor 24 detecting a rotation position of the cam 210 and so on) and operate a motor 305 and the motor 305 may change the rotation position of the cam 210 through a gear box 310. The position sensor 24 may be a sensor configured to directly detect a rotation position of the cam 210, or the controller 300 may be configured to indirectly calculate the rotation position of the cam 210 by detecting a rotation portion of the motor 305 using a resolver (not shown). The first coolant path 230*a* may be in fluid communication with the heater 115, the second coolant path 230*b* may be in fluid communication with the radiator 130, and the third coolant path 230*c* may be in fluid communication with the engine block 100.

Figure 4:
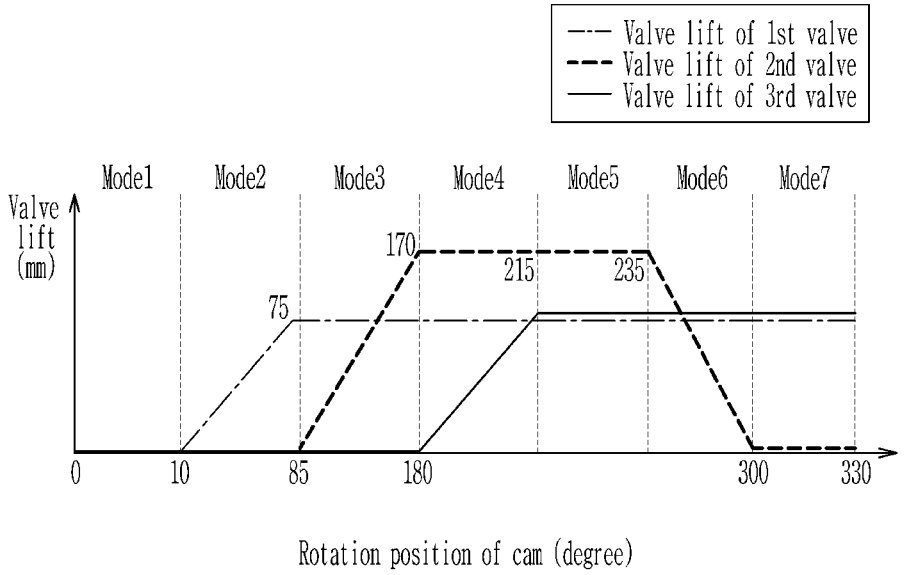
FIG. 4 is a graph of control modes of a control system applicable to a control method according to an exemplary embodiment of the present invention.

FIG. 4 is a graph of control modes of a control system applicable to a control method according to an exemplary embodiment of the present invention. In FIG. 4, the horizontal axis denotes a rotation position of the cam 210, and the vertical axis denotes valve lifts (or moving distance) of the respective valves 220*a*, 220*b*, and 220*c*. In particular, lifts of each valve 220*a*, 220*b* and 220*c* is proportional to the opening rates of the each coolant passage 230*a*, 230*b*, and 230*c*.

In the first mode, the first, second, and third coolant passages 230*a*, 230*b*, and 230*c* corresponding to the heater 115, the radiator 130 and the engine block 100 may be closed and the valve lift is zero. In the second mode, the second and third coolant passages 230*b* and 230*c* corresponding to the radiator 130 and the engine block 100 may be closed, and the opening rate of the first coolant passage 230*a* corresponding to the heater 115 and the LP-EGR cooler 110 may be adjusted. In the third mode, the third coolant passage 230*c* corresponding to the engine block 100 may be closed, the opening rate of the second coolant passage 230*b* corresponding to the radiator 130 may be adjusted, and the opening rate of the first coolant passage 230*a* corresponding to the heater 115 and the LP-EGR cooler 110 may be maximized.

In the fourth mode, the opening rate of the third coolant passage 230*c* corresponding to the engine block 100 may be adjusted, the opening rate of the second coolant passage 230*b* corresponding to the radiator 130 may be maximized, and the opening rate of the first coolant passage 230*a* corresponding to the heater 115 and the LP-EGR cooler 110 may be maximized. In the fifth mode, the opening rate of the third coolant passage 230*c* corresponding to the engine block 100 may be maximized, the opening rate of the second coolant passage 230*b* corresponding to the radiator 130 may be maximized, and the opening rate of the first coolant passage 230*a* corresponding to the heater 115 and the LP-EGR cooler 110 may be maximized.

In the sixth mode, the opening rate of the third coolant passage 230*c* corresponding to the engine block 100 may be maximized, the opening rate of the second coolant passage 230*b* corresponding to the radiator 130 may be adjusted, and the opening rate of the first coolant passage 230*a* corresponding to the heater 115 and the LP-EGR cooler 110 may be maximized. In the seventh mode, the opening rate of the third coolant passage 230*a* corresponding to the engine block 100 may be maximized, the second coolant passage 230*b* corresponding to the radiator 130 may be blocked, and the opening rate of the first coolant passage corresponding to the heater 115 and the LP-EGR cooler 110 may be maximized.

In the first mode, as the flow of the coolant is minimized, the temperature of the engine oil and the coolant may rapidly increase in the low temperature state. The second mode is a section operated using the heater or the LP-EGR cooler 110 and a warm-up is executed. The third mode is a section in which a target water temperature is adjusted by adjusting a cooling amount based on a driving region of the engine as a radiator cooling section.

The fourth mode adjusts the temperature of the engine block 100 as a cylinder block cooling section. The fifth mode is a section used in a driving condition in which an engine heating amount is high and it may be difficult to secure the cooling amount as a maximum cooling section. In the fifth mode, a separation cooling may be released to secure a cooling performance of the block. The sixth mode may separately adjust a target coolant temperature of the cylinder head and the block as a cylinder block and radiator cooling section.

Figure 5:
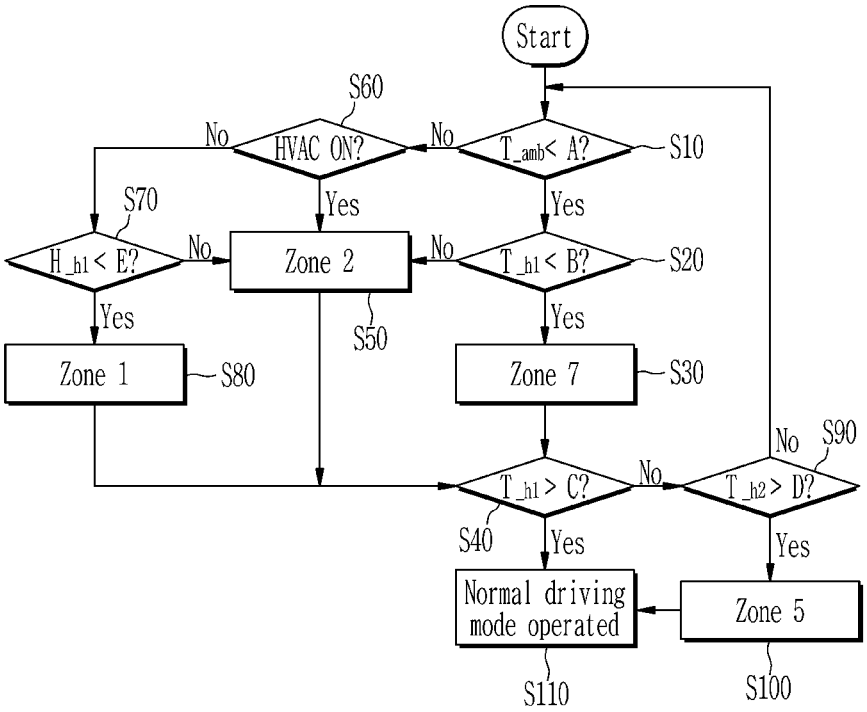
FIG. 5 is a flowchart showing a control method according to an exemplary embodiment of the present invention.

FIG. 5 is a flowchart showing a control method according to an exemplary embodiment of the present invention. The control method according to an exemplary embodiment of the present invention may be applied to the cooling system described above, and particularly the control method may be applied to a state in which the outside air temperature is low at the start of the engine, thereby securing the heating performance and protecting the engine by suppressing the sudden temperature change of the engine.

Particularly, the controller 300 may be configured to receive the output signal of the ambient temperature sensor 18 and determine whether the output signal of the ambient temperature sensor 18 satisfies a predetermined an ambient low temperature driving condition (S10). When the output signal of the ambient temperature sensor 18 satisfies the predetermined the ambient low temperature driving condition, the controller 300 may be configured to determine whether the output signal of the first coolant temperature sensor 12 satisfies a predetermined first low temperature driving condition (S20). When the output signal of the first coolant temperature sensor 12 satisfies the predetermined first low temperature driving condition, the controller 300 may be configured to operate the coolant control valve unit 125 to open the first coolant passage 230*a* and the third coolant passage 230*c* and to close the second coolant passage 230*b* (S30).

When ambient temperature T_amb is less than a predetermined ambient low temperature A, the controller 300 may be configured to that the ambient low temperature driving condition is satisfied. In particular, the value of the predetermined ambient low temperature A may be set to about minus 20° C., and the value may be varied according to the repetition of the control logic, that is, hysteresis may be suppressed so that frequent operation mode change is possible. The controller 300 may further be configured to determine that the first low temperature driving condition is satisfied when the coolant temperature T_h1 passing through the cylinder head 105 is less than B, where B may be set to about 70° C. The B may change its value in accordance with the repetition of the control logic, that is, hysteresis, so that it can suppress frequent operation mode change.

As shown in FIG. 4, when the ambient temperature condition is satisfied and the first low temperature driving condition is satisfied, even when the air conditioning system does not operate, the coolant control valve unit 125 may be adjusted in advance by the controller 300 and operate in the seventh mode to circulate the coolant in the engine block 100. The sudden temperature change of the engine block 100 according to the opening strategy characteristic of the cam 210 may be prevented.

Further, coolant may be supplied to the heater 115 to improve the heating performance under the low temperature condition. The controller 300 may be configured to determine whether the output signal of the first coolant temperature sensor 12 satisfies a predetermined warn driving condition (S40) and adjust the coolant control valve unit 125 to be operated in a normal driving mode when the output signal of the first coolant temperature sensor satisfies the predetermined warn driving condition (S110).

When the coolant temperature T_h1 passing through the cylinder head 105 exceeds C, the controller 300 may be configured to determine that the warm driving condition is satisfied. For example, the C may be set at about 90° C. The controller 300 may be configured to adjust the operation of the coolant control valve unit 125 in accordance with the signal of the vehicle operation state detecting portion 10 in the normal driving condition and the coolant control valve unit 125 to implement the first mode to the seventh mode. The control logic for controlling the operation of the coolant control valve unit 125 in accordance with such general operating conditions will be apparent to those of ordinary skill in the art, and a detailed description thereof will be omitted.

Further, the controller 300 may be configured to determine whether the output signal of the second coolant temperature sensor 14 satisfies a high temperature driving condition (S90) and operate the coolant control valve unit 125 to close first coolant passage 230*a*, the second coolant passage 230*b* and the third coolant passage 230*c* when the output signal of the second coolant temperature sensor 14 satisfies the high temperature driving condition (S100). The controller 300 may be configured to determine that the coolant temperature T_h2 flowing through the engine block 100 exceeds the high temperature driving condition D, for example, the temperature D may be set to about 110° C.

When the coolant temperature of the engine block 100 exceeds about 110° C. in the state where the coolant of the engine block 100 is stagnated, the engine block 100 needs to be cooled. Accordingly, the coolant control valve unit 125 may be operated by the controller 300 in the fifth mode to circulate the coolant in the engine block 100. Then, the controller 300 may be configured to adjust the operation of the coolant control valve unit 125 according to the signals of the vehicle operation state detecting portion 10 to implement the normal operation mode, i.e., the first to seventh modes described above may be executed.

The controller 300 may be configured to operate the coolant control valve unit 125 to adjust the opening rate of the first coolant passage 230*a* and to close the second coolant passage 230*b* and the third coolant passage 230*c* (S50) when the output signal of the first coolant temperature sensor 12 does not satisfy the predetermined first low temperature driving condition. The coolant control valve unit 125 may be operated by the controller 300 in the second mode so that the coolant in the engine block 100 is stagnated. And thus, the warming up of the block 100 may be performed more rapidly. Coolant may also be supplied to the heater 115 to improve the heating performance under the low temperature condition.

In addition, the controller 300 may be configured to determine whether the heater 115 is operated (S60), and then operate the coolant control valve unit 125 to adjust the opening rate of the first coolant passage 230*a* and to close the second coolant passage 230*b* and the third coolant passage 230*c* when the heater 115 is operated (S50). In other words, when the heater 115 is operated even if the ambient temperature T_amb is not in the low temperature driving condition, the coolant control valve unit 125 may be operated by the controller 300 in the second mode. The coolant in the engine block 100 may be stagnated to rapidly warm up the engine block 100 and the coolant may be supplied to the heater 115 to improve the heating performance.

The operation of the heater 115 may be determined, for example, by whether the driver operates a heater switch (not shown). The controller may be configured to determine whether the output signal of the first coolant temperature sensor 12 satisfies a predetermined second low temperature driving condition when the heater 115 is not operated (S70) and operate the coolant control valve unit 125 to close the first coolant passage 230*a*, the second coolant passage 230*b* and the third coolant passage 230*c* when the output signal of the first coolant temperature sensor 12 satisfies the predetermined second low temperature driving condition (S80).

The controller 300 may further be configured to determine that the second low temperature driving condition is satisfied when the coolant temperature T_h1 passing through the cylinder head 105 is less than E. The E may be set to, for example, about 50° C. In other words, when the heater 115 is not operated and the second low temperature driving condition is satisfied, the coolant control valve unit 125 may be operated by the controller 300 in the first mode. All of the first coolant passage 230*a*, the second coolant passage 230*b* and the third coolant passage 230*c* may be closed and the entire coolant of the cooling system may be stagnated. Therefore, the warming up of the engine 90 may be accelerated. If the second low temperature driving condition is not satisfied, in step S50 the controller 300 may be configured to operate the coolant control valve unit 125 to adjust the opening rate of the first cooling water passage 230*a* and to close the second coolant passage 230*b* and the third coolant passage 230*b*.

According to the control method of the cooling system according to the exemplary embodiment of the present invention, when the outside temperature and the coolant temperature are low, it may be possible to control the coolant to flow through the cylinder head and the engine block, thereby preventing sudden temperature change of the engine. Therefore, the thermal shock of the engine may be prevented, and coolant may be supplied to the heater from the beginning of the startup, thereby securing the heating performance.

According to the control method of the cooling system according to the exemplary embodiment of the present invention, the coolant of the cylinder head, or the cylinder head and the engine block may be supplied to the heater according to the outside temperature and the coolant temperature to secure the heating performance at the initial startup. That is, after the coolant control valve unit 125 is operated in the seventh mode, the first mode or the second mode may be operated in accordance with the coolant water temperature to improve the thermal shock prevention and the engine warm-up performance. Further, according to the control method of the cooling system according to the exemplary embodiment of the present invention, the coolant temperature of the cylinder head and the engine block may be independently operated to suppress the occurrence of knocking, and the fuel efficiency may be improved.

While this invention has been described in connection with what is presently considered to be practical exemplary embodiments, it is to be understood that the invention is not limited to the disclosed exemplary embodiments, but, on the contrary, is intended to cover various modifications and equivalent arrangements included within the spirit and scope of the appended claims.

What is claimed is:

1. A control method for a cooling system including a vehicle operation state detecting portion, the control method comprising:

determining, by the controller, whether an output signal of an ambient temperature sensor of the vehicle operation state detecting portion configured to detect a temperature of ambient air satisfies a predetermined ambient low temperature driving condition;

determining, by the controller, whether an output signal of a first coolant temperature sensor of the vehicle operation state detecting portion, configured to detect a temperature of coolant flowing through a cylinder head, satisfies a predetermined first low temperature driving condition when the output signal of the ambient temperature sensor satisfies the predetermined the ambient low temperature driving condition; and operating, by the controller, a coolant control valve unit configured to receive coolant from the cylinder head to open a first coolant passage and a third coolant passage and to close a second coolant passage when the output signal of the first coolant temperature sensor satisfies the predetermined first low temperature driving condition, wherein the first coolant passage communicates with a heater, the second coolant passage communicates with a radiator, and the third coolant passage communicates with an engine block, wherein the predetermined ambient low temperature driving condition is satisfied when the temperature of ambient air is less than a predetermined ambient low temperature, and wherein the predetermined first low temperature driving condition is satisfied when the temperature of the coolant passing through the cylinder head is less than a first threshold temperature.

2. The control method of claim 1, further comprising:

operating, by the controller, the coolant control valve unit to adjust the opening rate of the first coolant passage and to close the second coolant passage and the third coolant passage when the output signal of the first coolant temperature sensor does not satisfy the predetermined first low temperature driving condition.

3. The control method of claim 1, further comprising:

determining, by the controller, whether the heater is operated; and operating, by the controller, the coolant control valve unit to adjust the opening rate of the first coolant passage and to close the second coolant passage and the third coolant passage when the heater is operated.

4. The control method of claim 3, further comprising:

determining, by the controller, whether the output signal of the first coolant temperature sensor satisfies a predetermined second low temperature driving condition when the heater is not operated; and operating, by the controller, the coolant control valve unit to close the first coolant passage, the second coolant passage and the third coolant passage when the output signal of the first coolant temperature sensor satisfies the predetermined second low temperature driving condition, wherein the predetermined second low temperature driving condition is satisfied when the temperature of the cooling passing through the cylinder head is less than a second threshold temperature.

5. The control method of claim 4, further comprising:

operating, by the controller, the coolant control valve unit to adjust the opening rate of the first coolant passage and to close the second coolant passage and the third coolant passage when the output signal of the first coolant temperature sensor does not satisfy the predetermined second low temperature driving condition.

6. The control method of claim 1, further comprising:

determining, by the controller, whether the output signal of the first coolant temperature sensor satisfies a predetermined warn driving condition; and operating, by the controller, the coolant control valve unit to be operated in a normal driving mode when the output signal of the first coolant temperature sensor satisfies the predetermined warn driving condition, wherein the predetermined warn driving condition is satisfied when the temperature of the coolant passing through the cylinder head is greater than a third temperature threshold.

7. The control method of claim 1, further comprising:

determining, by the controller, whether the output signal of a second coolant temperature sensor of the vehicle operation state detecting portion, configured to detect a temperature of coolant flowing through the engine block, satisfies a high temperature driving condition; and operating, by the controller, the coolant control valve unit to close first coolant passage, the second coolant passage and the third coolant passage when the output signal of the second coolant temperature sensor satisfies the high temperature driving condition, wherein the high temperature driving condition is satisfied when the temperature of the coolant flowing through the engine block is greater than a fourth temperature threshold.

* * * * *